US010302350B2

(12) United States Patent
Read

(10) Patent No.: US 10,302,350 B2
(45) Date of Patent: May 28, 2019

(54) NEUTRAL GRIP REFRIGERATOR DOOR HANDLE

(71) Applicant: Haier US Appliance Solutions, Inc., Wilmington, DE (US)

(72) Inventor: Timothy R. Read, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/683,837

(22) Filed: Aug. 23, 2017

(65) Prior Publication Data

US 2019/0063820 A1 Feb. 28, 2019

(51) Int. Cl.
*F25D 23/02* (2006.01)

(52) U.S. Cl.
CPC ..... *F25D 23/028* (2013.01); *F25D 2400/06* (2013.01)

(58) Field of Classification Search
CPC ..... F25D 23/00; F25D 23/02; F25D 23/028
USPC ..... 312/401, 405, 405.1, 291, 292
See application file for complete search history.

(56) References Cited

U.S. PATENT DOCUMENTS 8,424,985 B2 4/2013 Kwon et al.
8,485,617 B2 * 7/2013 Park ..... F25D 23/028 312/405.1
9,322,591 B2 4/2016 Oh et al.
9,353,984 B2 5/2016 Kim et al.
9,410,732 B2 8/2016 Choi et al.
2011/0062844 A1 * 3/2011 Higami ..... F25D 23/025 312/405
2011/0273071 A1 * 11/2011 Kim ..... F25D 23/028 312/405
2012/0104909 A1 * 5/2012 Kaplan ..... F25D 23/02 312/204
2012/0326587 A1 * 12/2012 Jeong ..... F25D 23/02 312/405
2015/0241116 A1 * 8/2015 Choi ..... E05B 65/0042 312/404
2017/0059238 A1 * 3/2017 Becke ..... F25D 27/00
2017/0159994 A1 * 6/2017 Ding ..... F25D 29/005

FOREIGN PATENT DOCUMENTS

JP 5-87437 * 4/1993

* cited by examiner

*Primary Examiner* — James O Hansen
(74) *Attorney, Agent, or Firm* — Dority & Manning, P.A.

(57) ABSTRACT

A refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber defines an opening for receipt of food items at a front portion of the food storage chamber. The refrigerator appliance also includes a door comprising a body. The body of the door extends between a front surface and an opposing back surface. The door is positioned at the front portion of the food storage chamber and movable between a closed position and an open position to selectively sealingly enclose the food storage chamber. The refrigerator appliance further includes a handle assembly defining a neutral grip pocket handle on the front surface of the door.

16 Claims, 5 Drawing Sheets

NEUTRAL GRIP REFRIGERATOR DOOR HANDLE

FIELD

The subject matter of the present disclosure relates generally to refrigerator appliances.

BACKGROUND

Refrigerator appliances generally include a cabinet that defines chilled chambers for receipt of food items for storage. Certain refrigerator appliances include a fresh food chamber for storage of food items above the freezing temperature of water and a freezer chamber for storage of food items below the freezing temperature of water. The fresh food chamber and the freezer chamber can be positioned at various locations relative to each other within the cabinet. Consumers generally prefer chilled chambers that facilitate visibility and accessibility of food items stored therein.

Some refrigerator appliances include one or more pairs of rotatably mounted opposing doors. In certain refrigerator appliances, commonly referred to as side-by-side style refrigerator appliances, the fresh food chamber is positioned next to the freezer chamber within the cabinet. In such refrigerator appliances, a pair of rotatable mounted opposing doors may be provided, with one door of the pair of doors corresponding to each chamber. Other refrigerator appliances may include a pair of rotatably mounted opposing doors for access to a single opening, e.g., at the fresh food compartment. Such door configurations are generally referred to as French doors.

The doors of a refrigerator appliance are typically operated by pulling on a handle associated with each door. In some refrigerator appliances, the handles may be configured as pocket handles. For example, some refrigerator doors include a recess in a body of the door, typically accessed via an opening in a side surface of the door. However, pocket handles which are accessed via an opening in a side surface can be cumbersome to use. Such pocket handles are opposite grip handles, for example, in order to open a right side door having such a pocket handle, a user would have to reach across the user's body with the user's left hand to grip the side pocket handle, making it more difficult to then open the right door.

Accordingly, a pocket handle for a refrigerator appliance that addresses one or more of the noted challenges would be useful.

BRIEF DESCRIPTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber defines an opening for receipt of food items at a front portion of the food storage chamber. The refrigerator appliance also includes a door comprising a body. The body of the door extends between a front surface and an opposing back surface. The door is positioned at the front portion of the food storage chamber and movable between a closed position and an open position to selectively sealingly enclose the food storage chamber. The refrigerator appliance further includes a handle assembly defining a neutral grip pocket handle on the front surface of the door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
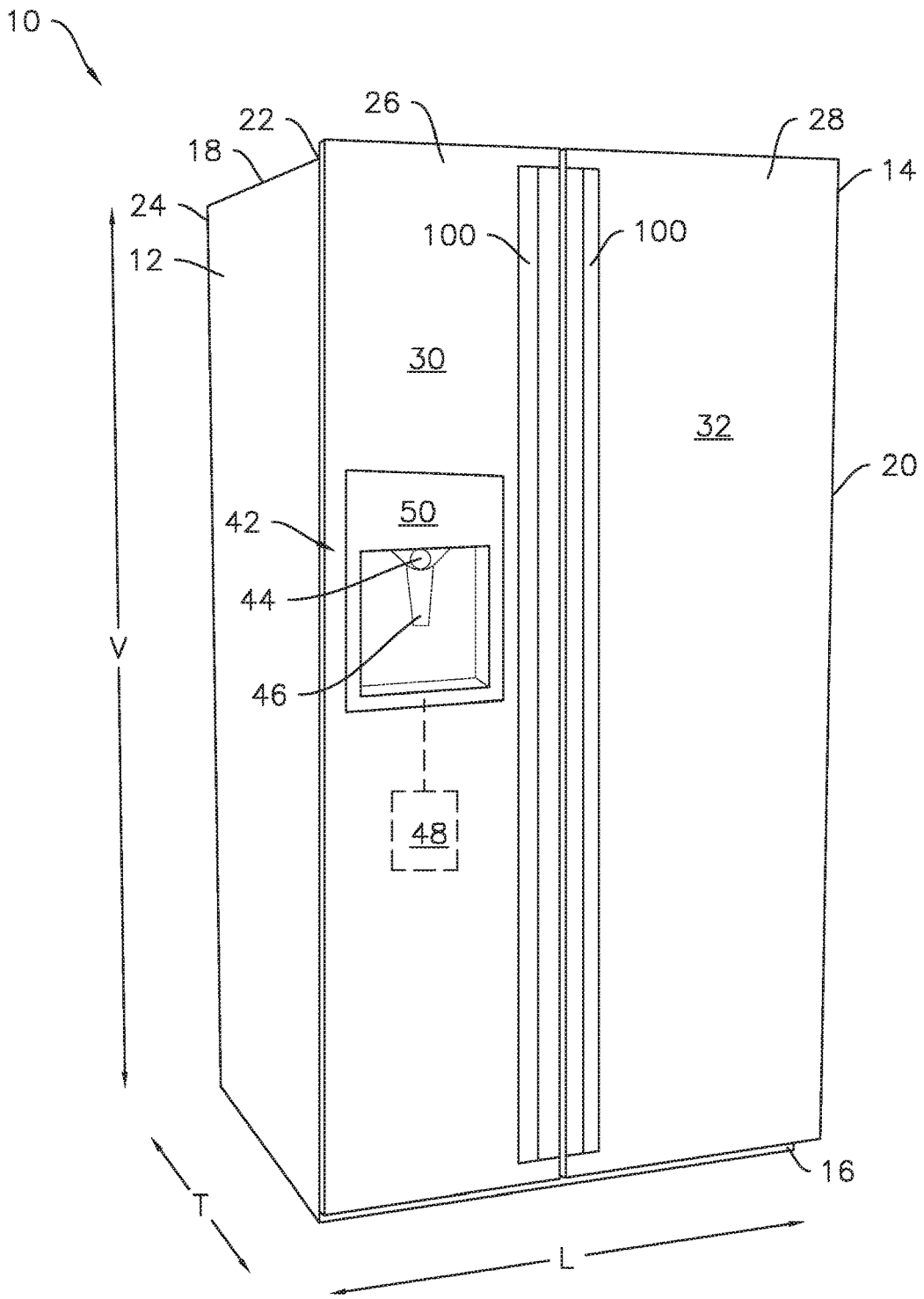
FIG. 1 provides a perspective view of a refrigerator appliance according to an exemplary embodiment of the present subject matter with the doors shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 10 according to an exemplary embodiment of the present subject matter. Refrigerator appliance 10 defines a vertical direction V, a lateral direction L, and a transverse direction T, the vertical direction V, the lateral direction L, and the transverse direction T are mutually perpendicular. Refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T. Cabinet 12 defines at least one food storage chamber, e.g., a chilled chamber or chambers defined in the cabinet 12 for receipt of food items for storage. As discussed in greater detail below, refrigerator appliance 10 includes features for assisting with accessing food items stored therein.

In some embodiments, cabinet 12 defines a first food storage chamber, e.g., a fresh food chamber, positioned at or adjacent right side 20 of cabinet 12 and a second food storage chamber, e.g., a freezer or frozen food storage chamber, arranged at or adjacent left side 18 of cabinet 12. The illustrated exemplary refrigerator appliance 10 is generally referred to as a side-by-side style refrigerator. It is recognized, however, that the benefits of the present disclosure apply to other types and styles of refrigerators such as, for example, a bottom mount refrigerator, a top mount refrigerator, a freezer appliance, and/or a French door refrigerator. Consequently, the description set forth herein is for illustrative purposes only and is not intended to be limiting in any aspect to a particular refrigerator configuration.

Refrigerator doors 26 and 28 are rotatably mounted to cabinet 12 such that the doors permit selective access to the food storage chambers defined within cabinet 12. Refrigerator doors 26 and 28 may be rotatable between a closed position (FIG. 1) and an open position (not shown) to selectively sealingly enclose the food storage chamber or chambers. As shown in the illustrated embodiments, refrigerator doors include a left refrigerator door 26 rotatably mounted to cabinet 12 at left side 18 of cabinet 12 to selectively sealingly enclose the frozen food storage chamber and a right refrigerator door 28 rotatably mounted to cabinet 12 at right side 20 of cabinet 12 to selectively sealingly enclose the fresh food storage chamber.

As illustrated in FIG. 1, refrigerator appliance 10 may also include a dispensing assembly 42 for dispensing liquid water and/or ice. Dispensing assembly 42 may be positioned on or mounted to an exterior portion of refrigerator appliance 10, e.g., on one of refrigerator doors 26 or 28. Dispensing assembly 42 includes a discharging outlet 44 for accessing ice and liquid water. An actuating mechanism 46, shown as a paddle, is mounted below discharging outlet 44 for operating dispensing assembly 42. In alternative exemplary embodiments, any suitable actuating mechanism may be used to operate dispensing assembly 42. For example, dispensing assembly 42 can include a sensor (such as an ultrasonic sensor) or a button rather than the paddle. A control panel 50 is provided for controlling the mode of operation. For example, control panel 50 includes a plurality of user inputs (not labeled), such as a water dispensing button and an ice-dispensing button, for selecting a desired mode of operation such as crushed or non-crushed ice.

Refrigerator appliance 10 further includes a controller 48. Operation of the refrigerator appliance 10 is regulated by controller 48 that is operatively coupled to control panel 50. In some exemplary embodiments, control panel 50 may represent a general purpose I/O ("GPIO") device or functional block. In some exemplary embodiments, control panel 50 may include input components, such as one or more of a variety of electrical, mechanical or electro-mechanical input devices including rotary dials, push buttons, touch pads, and touch screens. Control panel 50 can be communicatively coupled with controller 48 via one or more signal lines or shared communication busses. Control panel 50 provides selections for user manipulation of the operation of refrigerator appliance 10. In response to user manipulation of the control panel 50, controller 48 operates various components of refrigerator appliance 10. For example, controller 48 is operatively coupled or in communication with various components of a sealed refrigeration system, e.g., to set or adjust temperatures within the cabinet 12, such as within the fresh food storage chamber. Controller 48 may also be communicatively coupled with a variety of sensors, such as, for example, chamber temperature sensors or ambient temperature sensors. Controller 48 may receive signals from these temperature sensors that correspond to the temperature of an atmosphere or air within their respective locations.

Controller 48 may include memory and one or more processing devices such as microprocessors, CPUs or the like, such as general or special purpose microprocessors operable to execute programming instructions or micro-control code associated with operation of refrigerator appliance 10. The memory can represent random access memory such as DRAM, or read only memory such as ROM or FLASH. The processor executes programming instructions stored in the memory. The memory can be a separate component from the processor or can be included onboard within the processor. Alternatively, controller 48 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

With reference still to FIG. 1, each door 26 and 28 of refrigerator appliance 10 includes a handle assembly 100 positioned on a front surface 30 and 32, respectively, which may be used to move the respective door 26 or 28 between an open position and a closed position for accessing one of the chilled chambers defined within the cabinet 12 of refrigerator appliance 10. The handle assembly 100 of each door 26 and 28 is configured as a neutral grip pocket handle. Pocket handles are generally integral to the door and are created by forming a recess in a door body to provide a location for a user to grip the door, e.g., door 26 or 28. For example, such recess may allow a user to manipulate the door, e.g., by inserting a part of a hand, such as one or more fingers, into the recess to grip and pull the door open. As described in more detail hereinbleow, the handle assemblies 100 are neutral grip pocket handles in that the handle assemblies 100 can be operated by a user's corresponding hand without requiring a user to reach across the user's body to grip the desired handle assembly 100. For example, the handle assembly 100 of the right door 28 may be operated by a user's right hand, and without requiring the user to rotate a wrist to grip the handle assembly 100.

In some exemplary embodiments, e.g., as illustrated in FIG. 1, each handle assembly 100 extends generally along the vertical direction V along a substantial portion of the vertical dimension of each respective door 26, 28 as shown. For example, a substantial portion may include at least ninety percent (90%) of the vertical dimension of the respective door 26 or 28, such as about ninety-five percent (95%) of the vertical dimension of the respective door 26 or 28, such as about ninety-nine percent (99%) of the vertical dimension of the respective door 26 or 28. However, in some exemplary embodiments, handle assemblies 100 may extend over a lesser portion of the vertical dimension of the respective doors. For instance, handle assemblies 100 can extend along the vertical direction V about half (e.g., approximately 50%) of the vertical dimension of their respective doors 26 and 28. As used herein, terms of approximation, such as "generally," or "about" include values within ten percent greater or less than the stated value. Further, when used in the context of an angle or direction, such terms include within ten degrees of the stated angle or direction. For example, generally along the vertical direction V includes forming an angle of up to ten degrees clockwise or counterclockwise with respect to the vertical direction V.

Figure 2:
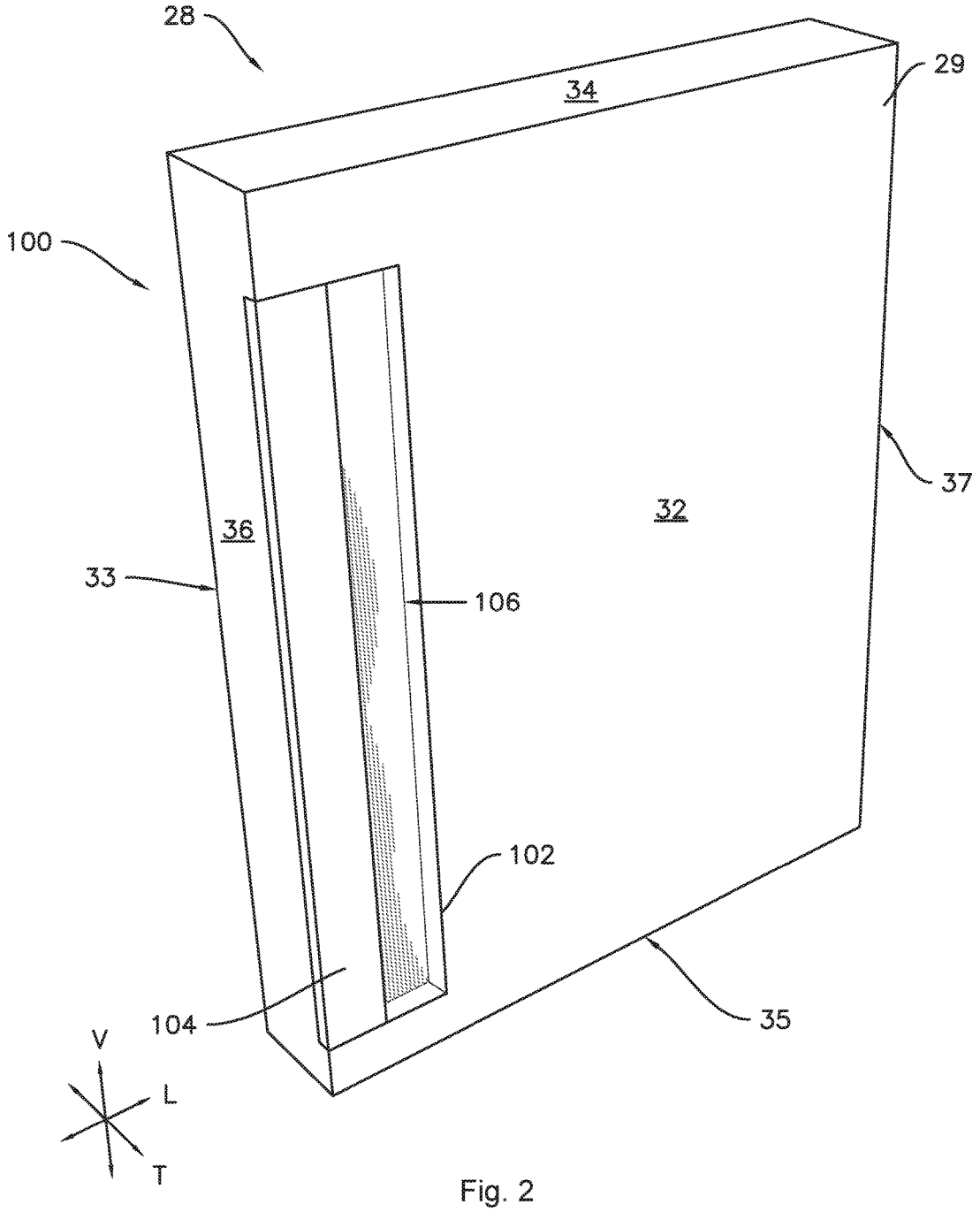
FIG. 2 provides a perspective view of an exemplary door of the exemplary refrigerator appliance of FIG. 1.

Turning now to FIG. 2, a single door is illustrated in a perspective view. The single door is shown in isolation in FIG. 2, for sake of clarity the adjoining components of the refrigerator appliance 10, e.g., the cabinet 12, are omitted from FIG. 2, although the door as illustrated is oriented in the closed position. By way of example and for illustration purposes only, FIG. 2 depicts right door 28. However, it is to be understood that some or all of the features shown and described with respect to door 28 may also be provided in various combinations with the left door 26. Additionally, some features may be modified, e.g., mirrored or otherwise adapted, to fit the left door 26, as would be generally understood by one of ordinary skill in the art.

As illustrated in FIG. 2, the door 28 defines a body 29 which is bounded by external surfaces 32, 33, 34, 35, 36, and 37. The body 29 of the door 28 extends between front surface 32 and back surface 33 along a first direction perpendicular to the vertical direction V, e.g., the transverse direction T, between top surface 34 and bottom surface 35 along the vertical direction V, and between inner surface 36 and outer surface 37 along a second direction perpendicular to the vertical direction V and to the first direction, e.g., the lateral direction L. The inner surface 36 may be understood as generally facing inward with respect to the refrigerator appliance 10, e.g., towards the other components of refrigerator appliance 10, particularly when the door 28 is in the closed position. For example, when both doors 26 and 28 are in the closed position, the inner surface 36 of door 28 will face the door 26, and in particular a corresponding inner surface (not shown) of the door 26, which may be a mirror image of door 28. The outer surface 37 may be understood as facing outward with respect to the refrigerator appliance 10 as a whole, e.g., when the door 28 is in the closed position, the outer surface 37 will face outward away from the refrigerator appliance 10. It should be noted that the coordinate directions, L, V, and T described herein and shown in FIG. 2 are with respect to the closed position of the door 28. One or ordinary skill in the art will recognize that the door 28 rotates through a plane including the lateral direction L and the transverse direction T, such that the orientation of the door 28 and particular features thereof with respect to the lateral direction L and the transverse direction T may vary when the door 28 is in use.

Figure 3:
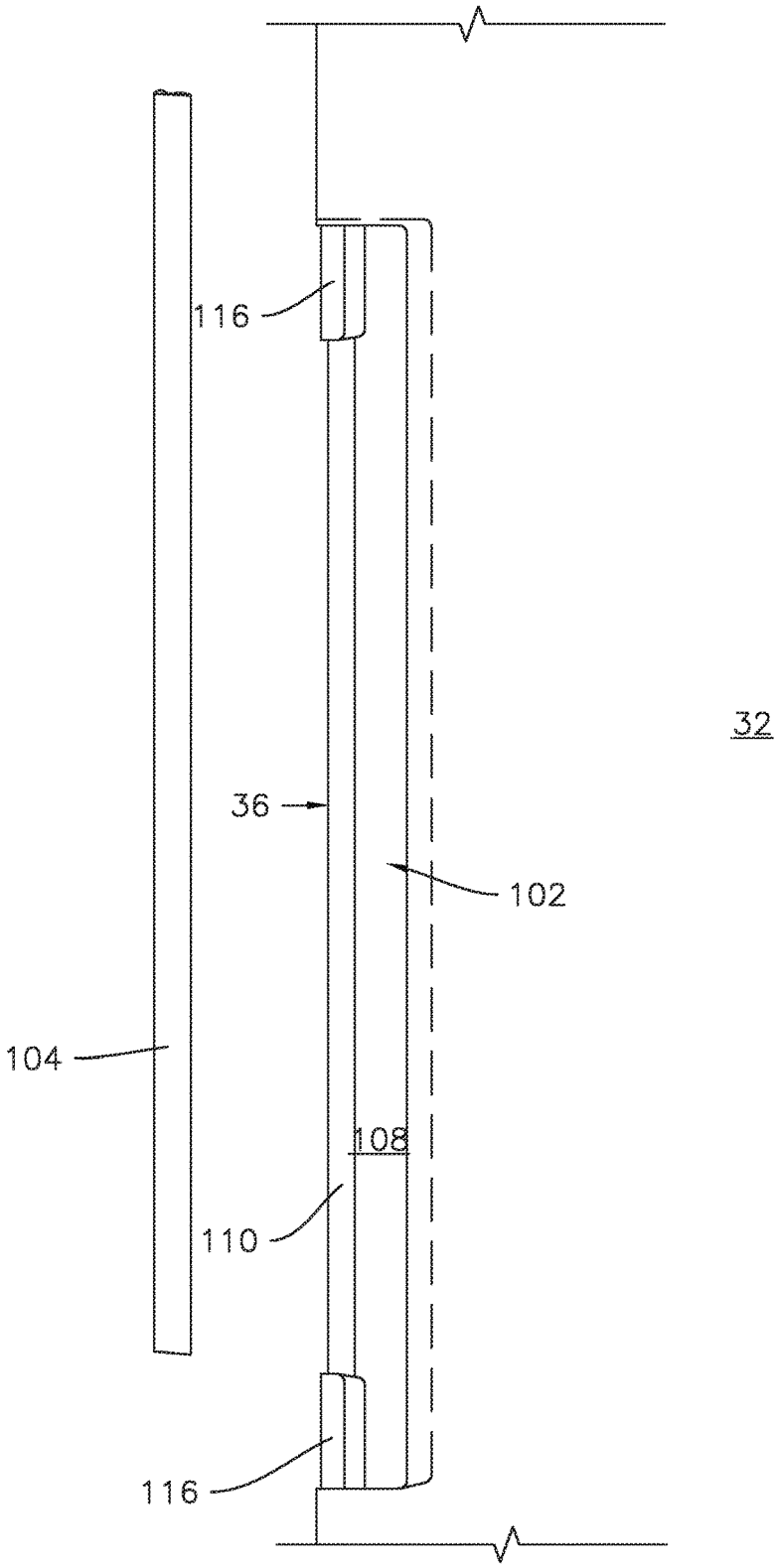
FIG. 3 provides an exploded view of an exemplary neutral grip pocket handle according to one or more embodiments of the present subject matter.

As shown in FIGS. 2 and 3, the handle assembly 100 generally includes a recess 102 and a handle insert 104. The recess 102 may be integrally formed in the body 29 of door 28 and may include one or more mounting blocks 116 for securing the handle insert 104 to the body 29 of the door 28. The recess 102 may be integrally formed in the body 29 in that the various walls defining the recess, as described in more detail below, are continuous with one or more surfaces 32, 33, 34, 35, 36, and 37 of the door 28. Further, the body 29 and the recess 102 may be integrally formed of a single piece of material providing a unitary and seamless construction. As is generally understood in the art, the door 28 may comprise a liner which provides the external surfaces 32, 33, 34, 35, 36, and 37 and insulating material inside the liner. Thus, where recess 102 is integrally formed in the body 29 of door 28, external surfaces of the recess 102 are also formed of the liner material and the insulating material extends behind and around the recess 102 in all directions.

As shown in FIG. 3, the recess 102 may extend to the inner surface 36 of the body 29 of the door, and when the handle insert 104 is secured to the recess 102, the recess 102 may be enclosed on the inner surface 36 by the handle insert 104. The handle insert 104 may be secured to the recess 102 at the mounting blocks 116 by any suitable method, such as but not limited to, fasteners, an interference fit, e.g., between a tab formed on the handle insert 104 and a slot formed on the mounting block(s) 116 of the recess 102, adhesives, welding, including solvent welding, soldering, brazing, etc., or any other suitable method or combination of methods. For example, both mechanical fasteners, e.g., threaded fasteners, and adhesive may be employed together. As seen in FIG. 2, when the handle assembly 100 is assembled, e.g., when handle insert 104 is secured to the recess 102, the handle assembly 100 defines an access opening 106 in the front surface 32 of door 28 The access opening 106 is contiguous with the recess 102. In particular, handle insert 104 may partially enclose the recess 102 at or along the front surface 32 and the access opening 106 may be defined by the unenclosed portion of the recess 102 at or along the front surface 32. Accordingly, a user may insert, e.g., one or more fingers, into the recess 102 via the access opening 106 to grip and pull the door 28 open. As noted above, the handle assembly 100 is a neutral grip pocket handle. For example, because the access opening 106 is positioned at the front surface 32 of the door 28, a user may grip the handle insert 104 of right door 28 with the user's right hand.

Figure 4:
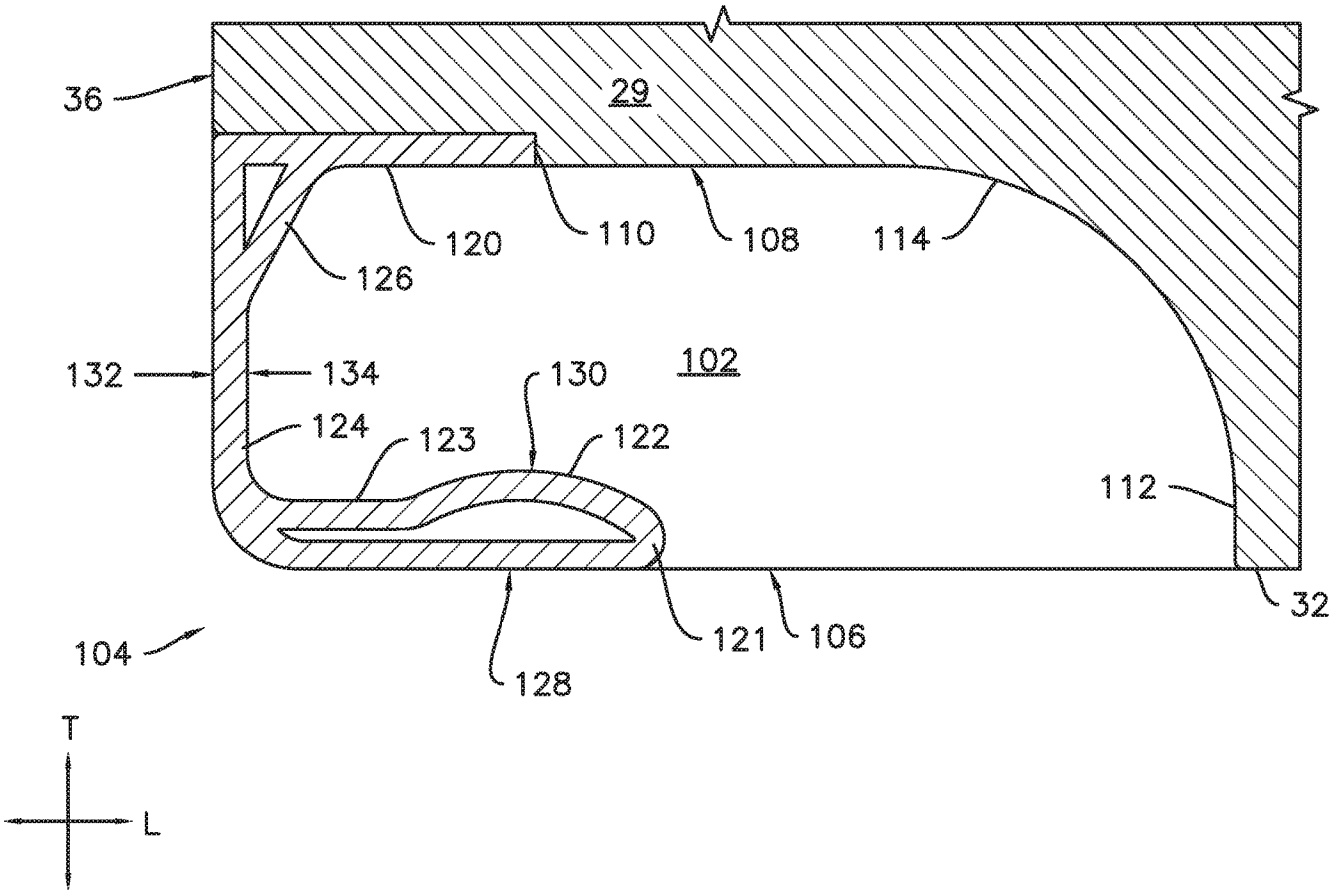
FIG. 4 provides a section view of the neutral grip pocket handle of FIG. 3.

As shown in FIGS. 3 and 4, the recess 102 includes a rear wall 108. A rabbet 110 may be provided in the recess 102, e.g., in the rear wall 108 at or adjacent to the inner surface 36 of the door 28. As shown in FIG. 4, the handle insert 104 may include an interface portion 120 which can be received in the rabbet 110 of the recess 102. The recess 102 may include several walls, for example, as shown in FIG. 4, the recess 102 may include a side wall 112 and a fillet or arcuate wall portion 114 extending between the side wall 112 and the rear wall 108. The handle insert 104 may include a front wall 121 extending between a front external surface 128 and a front internal surface 130 opposite the front external surface 128. The front external surface 128 may be generally aligned or coplanar with the front surface 32 of the door 28. The front internal surface 130 faces inwards towards the recess 102. The access opening 106 may be defined between the front wall 121 of the handle insert 104 and the side wall 112 of the recess 102. Additionally, the front internal surface 130 may include a flat portion 123 and an arcuate or rounded portion 122. Rounded portion 122 may provide a lip to guide a user to where the user needs to pull in order to open the door 28 via the handle assembly 100. The lip or rounded portion 122 may be a hidden lip in that the rounded portion 122 is disposed on the front internal surface 130 of the handle insert 104, such that the hidden lip is generally not visually apparent to the user but rather serves as a tactile indicator of the correct, e.g., most mechanically efficient, location to grip and pull the handle insert 104 in order to open the door 28. For example, a user's fingers may pass through the access opening 106 into the recess 102, then the user's fingers, e.g., the user's fingertips, may first encounter an intermediate wall 124 of the handle insert, in particular an internal surface 134 thereof, and/or may first encounter the flat portion 123 of the front internal surface 130, whereupon the user's fingers may travel along the intermediate internal surface 134 and flat portion 123 of front internal surface 130 until the fingers encounter the rounded portion 122. As noted above, the rounded shape of portion 122 provides a hidden lip which serves as a tactile indicator which may be perceived by the user's fingertips, to indicate the correct location to grip and pull the handle insert 104 when the user's fingers encounter the rounded portion 122.

Also as shown in FIG. 4, the intermediate wall 124 of the handle insert 104 may extend between the front wall 121 and the interface portion 120. The intermediate wall 124 may also define an external side surface 132 of the handle insert 104. As shown, the external side surface 132 may be generally aligned or coplanar with the inner surface 36 of the door 28. As noted above, terms of approximation such as "about," "generally," or "substantially," are to be understood as including within ten percent greater or less than the stated amount. For example, generally aligned includes the offset from the external side surface 132 of the handle insert 104 to the inner surface 36 of the door 28 at any point is within +/−10%, such as within +/−5%, such as within +/−4%, such as within +/−3%, such as within +/−2%, such as within +/−1%, such as within +/−0.5% of the overall dimension of the handle assembly 100, e.g., the straight line distance from the external side surface 132 of the handle insert 104 to the side wall 112 of the recess 102.

The portion of the handle insert 104 defined between the intermediate wall 124 and the interface portion 120 may be reinforced, e.g., to provide a robust and durable handle assembly 100 that can withstand repeated application of pulling force as the door 28 is opened repeatedly over the useful life of the refrigerator appliance 10. For example, the intermediate wall 124 and the interface portion 120 may define a corner, and the handle insert 104 may be relatively thicker at this corner than in other portions of the handle insert 104. For example, a cross-brace 126 may be provided extending between intermediate wall 124 and interface portion 120 at an internal corner of the handle insert 104.

Figures 5, 6, 7:
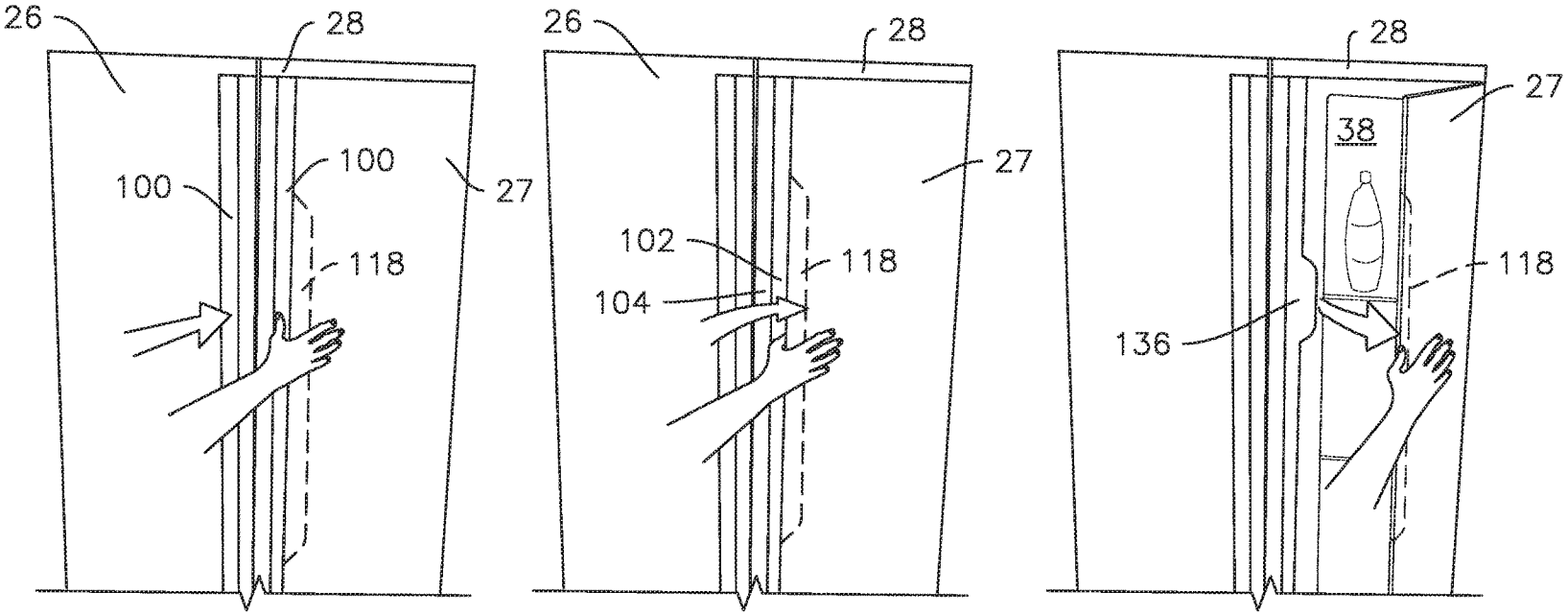
FIGS. 5 through 7 illustrate a sequence of use of an exemplary neutral grip pocket handle according to one or more embodiments of the present subject matter.

In some embodiments, one or more of the doors 26 and 28 may be part of a door-in-door assembly. A door-in-door assembly generally includes an inner door with an outer door movably coupled to the inner door such that the outer door can rotate between a closed position and an open position. The outer door of a door-in-door assembly is formed in the inner door, e.g., when the outer door is in the closed position, the outer door is substantially continuous with the inner door and may form a portion of the inner door. For example, in some embodiments, e.g., as shown in FIGS. 5-7, door 28 may be an inner door provided in combination with an outer door 27. In such embodiments, the body 29 of the door 28 may be partially defined by the outer door 27. The handle assembly 100 may include an auxiliary recess 118 formed in the body 29 of the door(s) 27 and/or 28, and in particular in the portion of the body 29 defined by the outer door 27. The auxiliary recess 118 may be contiguous with the recess 102 and opposite the handle insert 104. The auxiliary recess 118 may be formed in the outer door 27 to permit a user to open the outer door 27 independently of the inner door 28 where the user may then access a food storage compartment 38 defined within the cabinet 12 of the refrigerator appliance 10. Thus, the outer door 27 may be rotatably mounted to the inner door 28 and the outer door 27 may be movable between an open position and a closed position by gripping and pulling on the auxiliary recess 118. A notch 136 may be provided in the inner door 28 and may be positioned to generally correspond to the auxiliary recess 118 of the outer door 27. In this regard, the inner door 28 may be configured to allow the user to place a hand into the auxiliary recess 118 of the outer door 27. As illustrated in FIGS. 5-7, the user may insert a part of the user's hand, e.g., a thumb, through the access opening 106, through the recess 102, and from there into the auxiliary recess 118. As shown, the notch 136 may provide additional clearance space for the user's thumb to extend through the recess 102 and into the auxiliary recess 118. Accordingly, the handle assembly 100 may provide a neutral grip pocket handle for both the inner door 28 and the outer door 27 of a door-in-door assembly, e.g., because the user may open the outer door 27 with a hand corresponding to the outer door 27. For example, as illustrated in FIGS. 5-7, the user may open either the inner door 28 or the outer door 27 on the right side 20 of refrigerator appliance 10 with the user's right hand.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber defining an opening for receipt of food items at a front portion of the food storage chamber;

a first door and a second door positioned at the front portion of the food storage chamber and movable between a closed position and an open position to selectively sealingly enclose the food storage chamber;

the first door comprising a body, the body of the first door extending between a front surface and an opposing back surface along the transverse direction when the first door is in the closed position, and between an inner surface and an outer surface along the lateral direction when the first door is in the closed position;

the second door comprising a body, the body of the second door extending between a front surface and an opposing back surface along the transverse direction when the second door is in the closed position, and between an inner surface and an outer surface along the lateral direction when the second door is in the closed position, the inner surface of the second door facing the inner surface of the first door when the first door and the second door are in the closed position;

a first handle assembly defining a first neutral grip pocket handle on the front surface of the first door, the first handle assembly comprising a first recess defined in the body of the first door and a first handle insert, the first recess enclosed on the inner surface of the first door by the first handle insert, the first handle insert comprising an intermediate wall which defines an external side surface of the first handle insert, the external side surface of the first handle insert coplanar with the inner surface of the first door; and a second handle assembly defining a second neutral grip pocket handle on the front surface of the second door, the second handle assembly comprising a second recess defined in the body of the second door and a second handle insert, the second recess enclosed on the inner surface of the second door by the second handle insert, the second handle insert comprising an intermediate wall which defines an external side surface of the second handle insert, the external side surface of the second handle insert coplanar with the inner surface of the second door.

2. The refrigerator appliance of claim 1, wherein the first neutral grip pocket handle comprises an access opening defined in the front surface of the first door, the access opening of the first neutral grip pocket handle contiguous with the first recess, and the second neutral grip pocket handle comprises an access opening defined in the front surface of the second door, the access opening of the second neutral grip pocket handle contiguous with the second recess.

3. The refrigerator appliance of claim 1, wherein the first recess comprises a mounting block, the first handle insert secured to the first recess at the mounting block of the first recess, and the second recess comprises a mounting block, the second handle insert secured to the second recess at the mounting block of the second recess.

4. The refrigerator appliance of claim 3, wherein the first recess comprises a rear wall and a rabbet provided in the rear wall adjacent to the inner surface of the first door and the second recess comprises a rear wall and a rabbet provided in the rear wall adjacent to the inner surface of the second door.

5. The refrigerator appliance of claim 4, wherein the first handle insert includes an interface portion received in the rabbet of the first recess and the second handle insert includes an interface portion received in the rabbet of the second recess.

6. The refrigerator appliance of claim 5, wherein the first handle insert comprises a cross-brace extending between an intermediate wall of the first handle insert and the interface portion of the first handle insert and the second handle insert comprises a cross-brace extending between an intermediate wall of the second handle insert and the interface portion of the second handle insert.

7. The refrigerator appliance of claim 1, wherein the first handle insert comprises a rounded portion on an internal surface of the first handle insert, the internal surface of the first handle insert facing inward towards the first recess and the second handle insert comprises a rounded portion on an internal surface of the second handle insert, the internal surface of the second handle insert facing inward towards the second recess.

8. The refrigerator appliance of claim 7, wherein the rounded portion of the first handle insert is disposed proximate to an access opening defined in the front surface of the first door and the rounded portion of the second handle insert is disposed proximate to an access opening defined in the front surface of the second door.

9. The refrigerator appliance of claim 8, wherein the access opening of the first door is defined between a front wall of the first handle insert and a side wall of the first recess, and the access opening of the second door is defined between a front wall of the second handle insert and a side wall of the second recess.

10. The refrigerator appliance of claim 9, wherein the first handle insert comprises a front external surface defined on the front wall of the first handle insert, the front external surface of the first handle insert is-generally aligned with the front surface of the first door, and the second handle insert comprises a front external surface defined on the front wall of the second handle insert, the front external surface of the second handle insert generally aligned with the front surface of the second door.

11. The refrigerator appliance of claim 7, wherein the internal surface of the first handle insert comprises a flat portion adjacent to the rounded portion and the internal surface of the second handle insert comprises a flat portion adjacent to the rounded portion.

12. The refrigerator appliance of claim 1, wherein the first door is an inner door, further comprising an outer door rotatably mounted to the inner door, wherein the outer door is rotatable between a closed position and an open position.

13. The refrigerator appliance of claim 12, wherein the body of the first door is partially defined by the outer door.

14. The refrigerator appliance of claim 12, further comprising an auxiliary recess contiguous with the first recess opposite the first handle insert, the auxiliary recess extending into the portion of the body of the first door defined by the outer door.

15. The refrigerator appliance of claim 14, wherein the outer door is rotatable between the open position and the closed position by pulling on the auxiliary recess.

16. The refrigerator appliance of claim 14, further comprising a notch in the inner door positioned to generally correspond to the auxiliary recess of the outer door.

* * * * *